US010358756B2

(12) United States Patent
Park et al.

(10) Patent No.: US 10,358,756 B2
(45) Date of Patent: Jul. 23, 2019

(54) WASHING MACHINE AND METHOD OF CONTROLLING THE SAME

(71) Applicant: LG ELECTRONICS INC., Seoul (KR)

(72) Inventors: Youngbae Park, Seoul (KR); Jonga Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 17 days.

(21) Appl. No.: 15/551,433

(22) PCT Filed: Feb. 17, 2016

(86) PCT No.: PCT/KR2016/001591
§ 371 (c)(1),
(2) Date: Aug. 16, 2017

(87) PCT Pub. No.: WO2016/133357
PCT Pub. Date: Aug. 25, 2016

(65) Prior Publication Data

US 2018/0030636 A1 Feb. 1, 2018

(30) Foreign Application Priority Data

Feb. 17, 2015 (KR) ..... 10-2015-0024408

(51) Int. Cl.
*D06F 33/02* (2006.01)
*D06F 39/00* (2006.01)
(Continued)

(52) U.S. Cl.
CPC ..... *D06F 33/02* (2013.01); *D06F 13/00* (2013.01); *D06F 35/00* (2013.01); *D06F 35/006* (2013.01); *D06F 37/12* (2013.01); *D06F 37/24* (2013.01); *D06F 37/304* (2013.01); *D06F 37/36* (2013.01); *D06F 37/40* (2013.01); *D06F 39/00* (2013.01); *D06F 39/005* (2013.01); *D06F 39/02* (2013.01); *D06F 39/085* (2013.01);
(Continued)

(58) Field of Classification Search
CPC ..... D06F 33/02
See application file for complete search history.

(56) References Cited

FOREIGN PATENT DOCUMENTS

| | | |
|---|---|---|
| JP | 2004-141344 | 5/2004 |
| JP | 2014-133182 | 7/2014 |

(Continued)

OTHER PUBLICATIONS

Yamamoto et al., Jul. 2014, JP2014133182, English machine translation (Year: 2014).*

(Continued)

*Primary Examiner* — Jason Y Ko
(74) *Attorney, Agent, or Firm* — Ked & Associates, LLP

(57) ABSTRACT

A method of controlling a washing machine includes (a) supplying water into a tub up to a first predetermined level, (b) rotating a basket so as to wash a filter provided between the tub and an opening formed in a lower portion of the basket by a water stream, (c) supplying water to elevate a level of water in the tub from the first predetermined level to a second predetermined level, and (d) rotating the basket to raise the water between the basket and the tub above the upper end of the basket by centrifugal force and to fall into the basket.

20 Claims, 6 Drawing Sheets

(51) Int. Cl.

| | |
|---|---|
| ***D06F 35/00*** | (2006.01) |
| ***D06F 39/08*** | (2006.01) |
| ***D06F 39/10*** | (2006.01) |
| ***D06F 37/30*** | (2006.01) |
| ***D06F 13/00*** | (2006.01) |
| ***D06F 37/12*** | (2006.01) |
| ***D06F 37/24*** | (2006.01) |
| ***D06F 37/36*** | (2006.01) |
| ***D06F 37/40*** | (2006.01) |
| ***D06F 39/02*** | (2006.01) |
| *D06F 23/04* | (2006.01) |

(52) U.S. Cl.

CPC ..... *D06F 39/087* (2013.01); *D06F 39/088* (2013.01); *D06F 39/10* (2013.01); *D06F 23/04* (2013.01); *D06F 39/083* (2013.01); *D06F 2202/085* (2013.01); *D06F 2204/065* (2013.01); *D06F 2204/084* (2013.01); *D06F 2204/086* (2013.01)

(56) References Cited

FOREIGN PATENT DOCUMENTS

| | | |
|---|---|---|
| KR | 10-1999-0041410 | 6/1999 |
| KR | 10-0645651 | 11/2006 |
| KR | 10-0933701 | 12/2009 |

OTHER PUBLICATIONS

International Search Report and Written Opinion dated Jul. 16, 2016 issued in Application No. PCT/KR2016/001591 (Full English Text).

* cited by examiner

[Fig. 1]
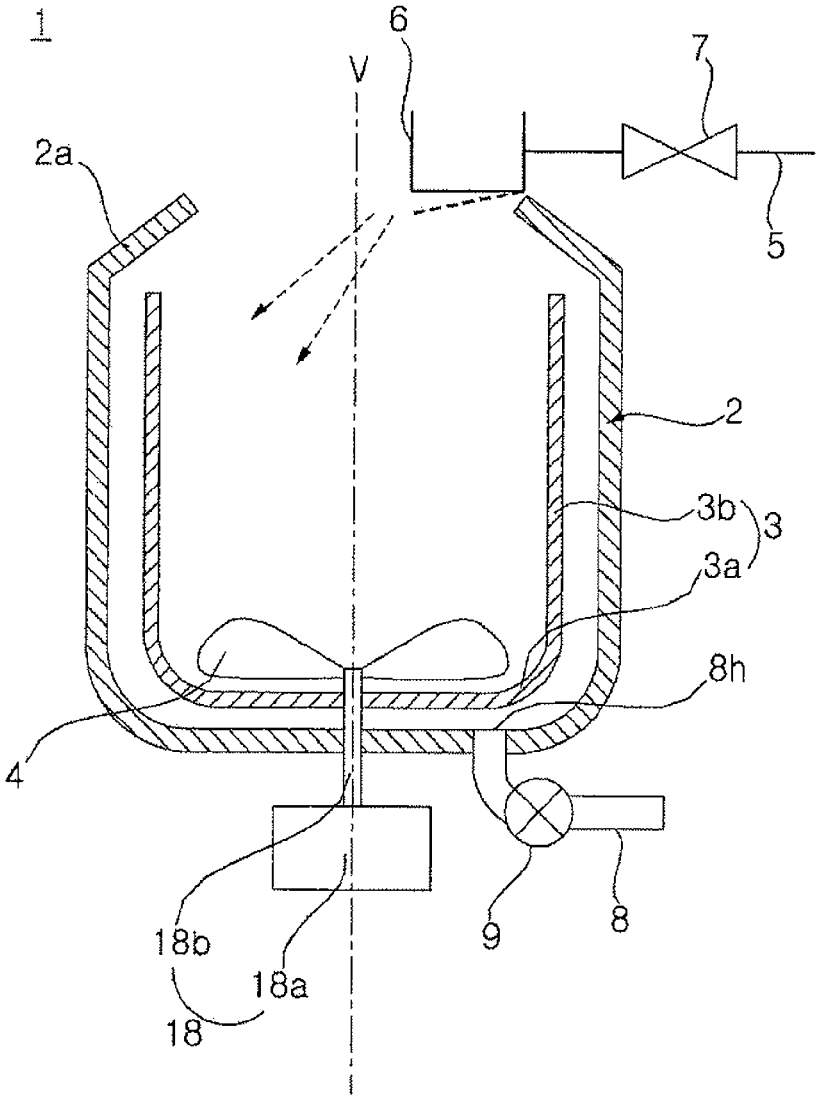

[Fig. 2]
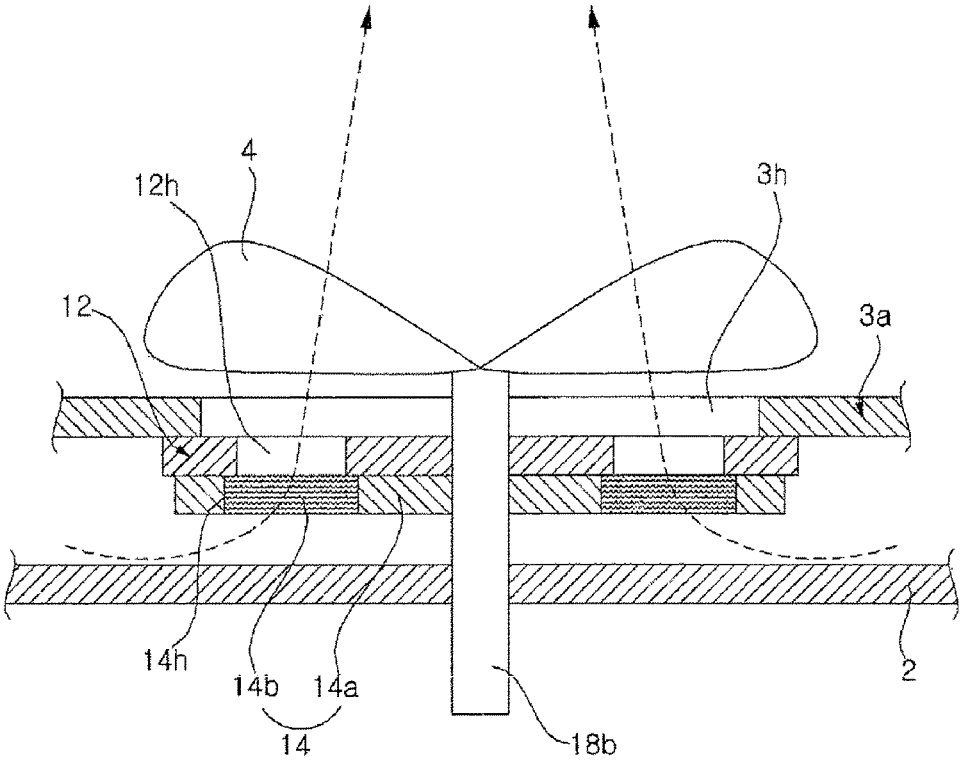
[Fig. 3]
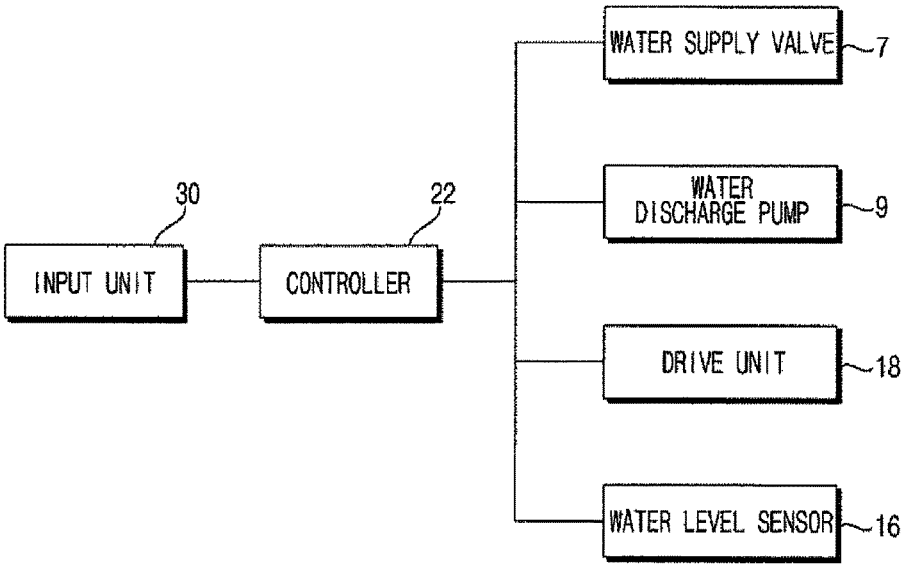

[Fig. 4]
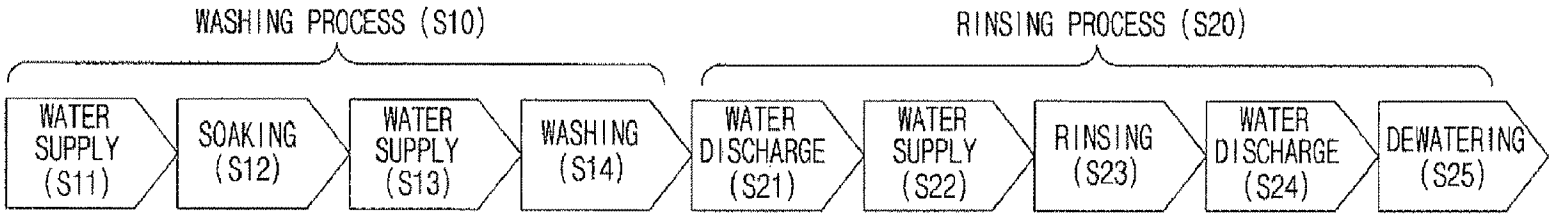

[Fig. 5]
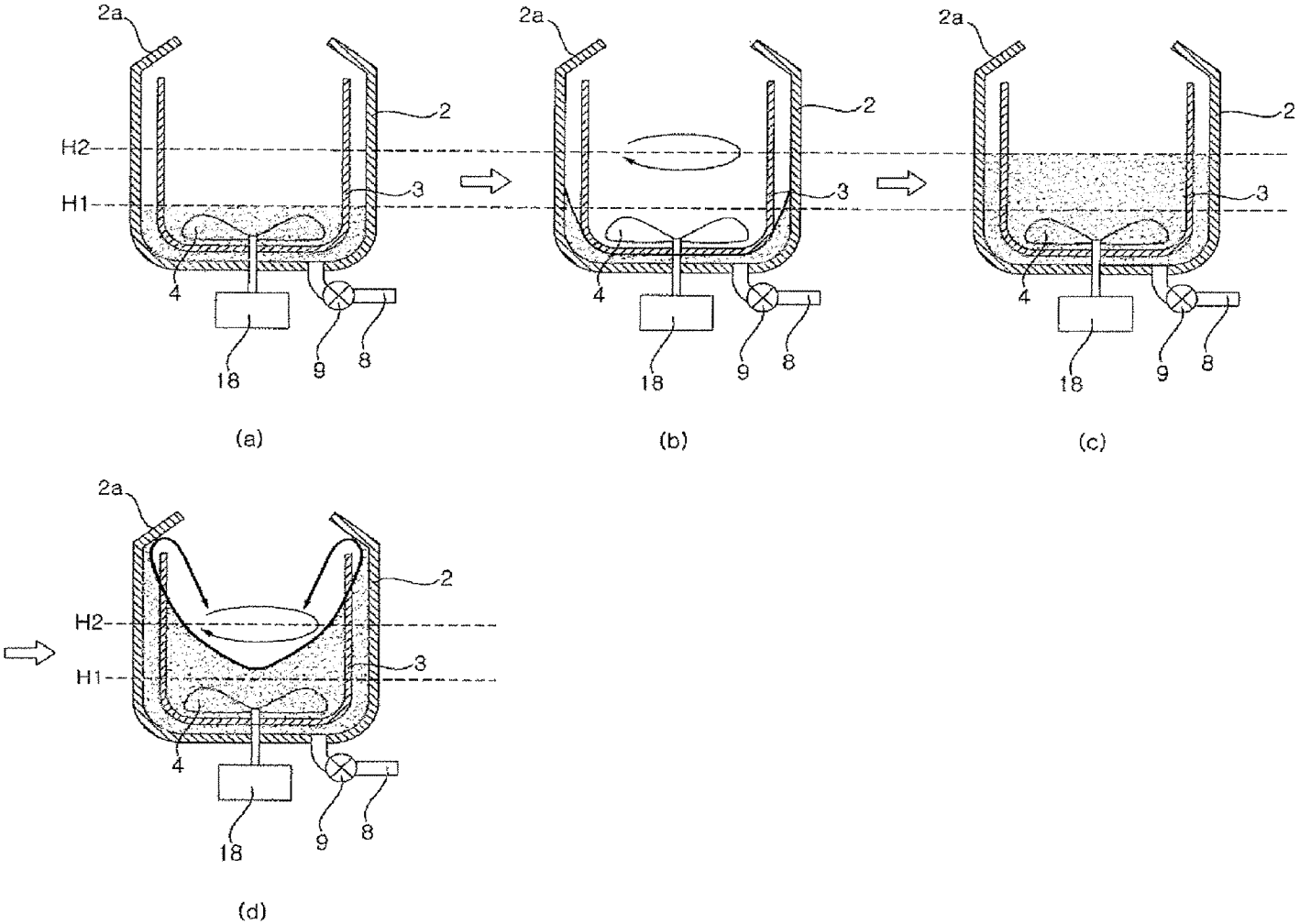

[Fig. 6]
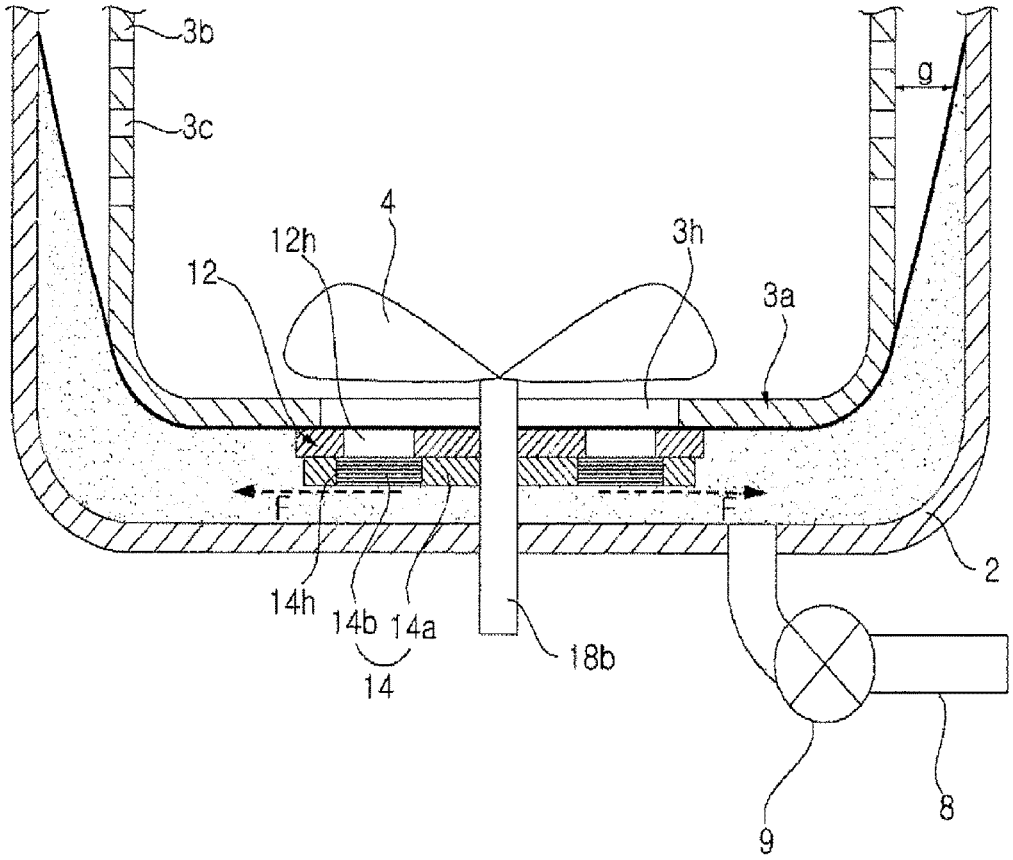

[Fig. 7]
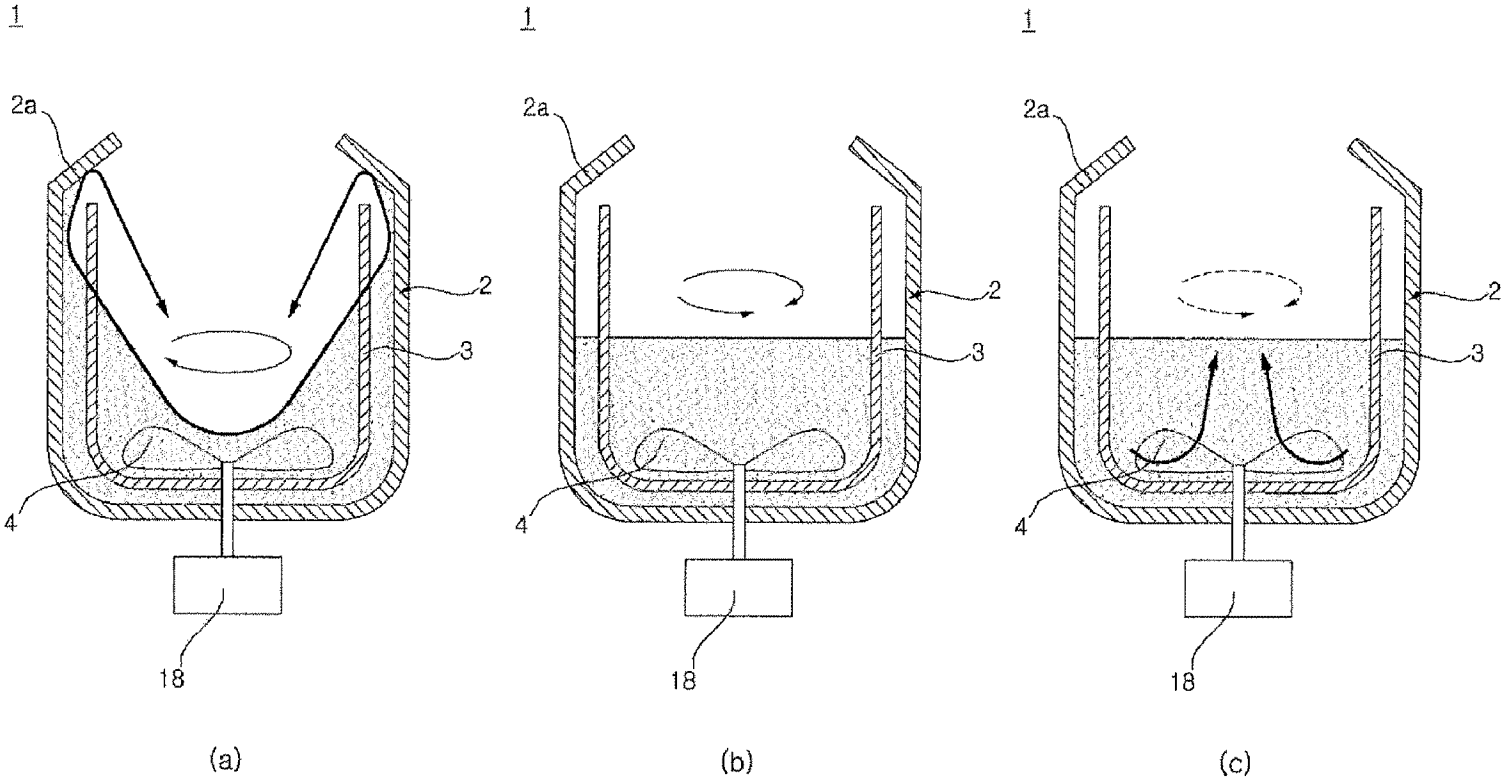

WASHING MACHINE AND METHOD OF CONTROLLING THE SAME

CROSS-REFERENCE TO RELATED PATENT APPLICATIONS

This application is a U.S. National Stage Application under 35 U.S.C. § 371 of PCT Application No. PCT/KR2016/001591, filed Feb. 17, 2016, which claims priority to Korean Patent Application No. 10-2015-0024408, filed Feb. 17, 2015, whose entire disclosures are hereby incorporated by reference.

TECHNICAL FIELD

The present disclosure relates to a washing machine and a method of controlling the same.

BACKGROUND ART

A washing machine washes laundry using the surfactant action of detergent, a water stream generated via rotation of a washing tub or a washing blade, shocks applied by the washing blade, or the like. The washing machine performs washing, rinsing and/or dehydration processes to remove contaminants adhering to laundry, e.g., clothes, using the interaction of water and detergent.

A washing machine includes a casing defining the appearance of the washing machine, an imperforated tub, which is disposed in the casing in a suspended state, and a perforated basket or drum, which is rotatably disposed in the tub. Since the basket and the tub are contaminated due to various causes such as scaling, slime, solidified detergent or the like with repeated use for an extended time, it may be necessary to periodically carry out an operation of washing the tub (hereinafter, an operation of cleaning the tub and components disposed in the tub is defined as "tub washing") to remove the contamination sources.

A tub washing is performed by supplying a sufficient amount of water to a tub to simultaneously wash the upper and lower parts of the tub. Since there is a difference in accumulation of pollutants between the upper and lower parts of the tub, the upper and lower parts of the tub should be respectively washed in different manners in order to thoroughly clean both the upper and lower parts of the tub. However, even though components such as a pulsator, a hub for coupling a basket to a rotating shaft, a filter and the like having greater amount of pollutants, are disposed at a lower portion of the tub, the washing machine performs tub washing without discriminating between the upper and lower parts of the tub, resulting in inefficient washing.

DISCLOSURE OF INVENTION

Technical Problem

The present disclosure provides a washing machine and a method of controlling the same capable of thoroughly washing the entire interior area of a tub.

The present disclosure provides a washing machine and a method of controlling the same generating an intense water stream in the lower region of the tub.

Solution to Problem

In accordance with an aspect of the present disclosure to achieve the above, a washing machine may include a tub for storing water, a basket, which is disposed in the tub so as to be rotatable about a vertical axis, the basket having an opening formed in a lower portion thereof so as to allow the basket to communicate with the tub, and a plurality of through holes formed in a side wall thereof through which water flows laterally, a pulsator, which is rotatably disposed at a lower portion of the basket, a filter for filtering water that flows from the tub to the basket through the opening during rotation of the pulsator, a water supply valve for supplying water to the tub, a water discharge pump for discharging water from the tub, a drive unit for driving at least one of the pulsator and the basket, and a controller for controlling the water supply valve so as to supply water to a first set level, controlling the drive unit to rotate the basket so as to raise water between the basket and the tub using centrifugal force, controlling the water supply valve so as to elevate the water level from the first set level to a second set level, and controlling the drive unit to rotate the basket so as to raise water between the basket and the tub above the upper end of the basket using the centrifugal force and then to fall into the basket.

The controller may control the drive unit to repeatedly perform rotation and braking of the basket for a predetermined period of time while a water level is maintained at the first set level. The controller may control the drive unit to repeatedly perform the rotation and braking of the basket at regular intervals.

When water is supplied to the first set level, the water may be supplied together with detergent. The detergent may include at least one of an oxygen bleaching agent and an oxygen cleaning agent.

The first set value may be set such that at least a portion of the pulsator is immersed in water.

The controller may control the drive unit to rotate the basket so as to raise water between the basket and the tub above the upper end of the basket using the centrifugal force and to fall into the basket, and may then control the water discharge pump to discharge the water in the tub. The controller may control the drive unit to rotate the basket while the water discharge pump is operated.

In accordance with another aspect of the present disclosure, a method of controlling a washing machine may include supplying water into a tub up to a first set level, (b) rotating a basket so as to wash a filter disposed between the tub and an opening formed in the lower portion of the basket using a water stream, (c) supplying water to elevate the level of water in the tub from the first set level to a second set level, and (d) rotating the basket to raise the water between the basket and the tub above the upper end of the basket using centrifugal force and to fall into the basket.

The rotation step (b) may include repeatedly performing rotation and braking of the basket for a predetermined period of time.

The rotation and braking of the basket may be repeatedly performed at regular intervals.

In the water supplying step (a), water may be supplied together with detergent. The detergent may include at least one of an oxygen bleaching agent and an oxygen cleaning agent.

The first set value may be set such that at least a portion of a pulsator, which is disposed at a lower portion of the basket above the filter, is immersed in water.

The method may further include, after the (d) rotating the basket, (e) discharging water in the tub. The discharging step (e) may include rotating the basket while the water in the tub is discharged. The method may further include after the discharging step (e), (f) supplying water to the tub again, (g)

rotating at least one of the basket and the pulsator, and (h) discharging the water in the tub. The discharging step (h) may include rotating the basket while the water in the tub is discharged. In the discharging step (h), the basket may be rotated in a direction opposite to that in the discharging step (e).

Advantageous Effects of Invention

The washing mashing and the method of controlling the same according to the present disclosure offer an effect of being capable of thoroughly washing the entire interior area of a tub. In particular, by respectively washing the upper and lower part of the tub in such a manner, washing performance and efficiency are improved compared to the background art.

Furthermore, components such as a basket and a tub, a pulsator, a hub, a filter or the like are predominantly washed.

BRIEF DESCRIPTION OF DRAWINGS

The embodiments will be described in detail with reference to the following drawings in which like reference numerals refer to like elements wherein:

FIG. 1 is a cross-sectional view schematically showing a washing machine according to an embodiment of the present disclosure;

FIG. 2 is a fragmentary cross-sectional view showing a portion of the washing machine shown in FIG. 1;

FIG. 3 is a block diagram showing the control relationship between the major components constituting the washing machine according to the embodiment of the present disclosure;

FIG. 4 is a flowchart showing a method of controlling the washing machine according to an embodiment of the present disclosure;

FIG. 5 is a view sequentially showing the operation of the washing machine in the washing process shown in FIG. 4;

FIG. 6 is a cross-sectional view specifically showing the level of water in the tub shown in FIG. 5(*b*); and FIG. 7 is a cross-sectional view sequentially showing the operation of the washing machine in a rinsing step constituting the rinsing process shown in FIG. 4.

BEST MODE FOR CARRYING OUT THE INVENTION

Referring to FIGS. 1 to 3, the washing machine 1 may include a tub 2 to store water, a basket or a drum 3 rotatably disposed in the tub 2 to hold laundry, and a pulsator 4 rotatably provided at the bottom of the basket 3.

The tub 2 is provided in a casing defining the appearance of the washing machine 1, and may be suspended from the casing by a suspension so as to absorb vibrations generated by the rotation of the basket 3. The basket 3 is rotated about the vertical axis V, and the tub 2 is open at the upper end so as to allow clothes to be introduced thereinto from above. The tub 2 may be provided thereover with an annular cover 2*a* for guiding a water stream The annular cover 2*a* is raised above the upper end of the basket 3 along the channel between the tub 2 and the basket 3 due to the centrifugal force while the basket 3 is rotated at an appropriate speed, into the basket 3.

The basket 3 may be rotatably provided in the tub 2, and may be provided in the bottom thereof with an opening 3*h* so as to allow the basket 3 to communicate with the tub 2. The basket 3 is also provided at the side wall with a plurality of through holes 3*c* (see FIG. 6) through which allows laterally flowing water to pass. For example, the basket 3 may include a side wall 3*b*, which extends around the vertical axis V, and a base 3*a*, which is coupled to the lower end of the side wall 3*b* so as to constitute the bottom of the basket 3 and has the opening 3*h* formed in the center thereof. The side wall 3*b* and the base 3*a* may be a single piece, but may also be formed of separate pieces coupled to each other.

The pulsator 4 may have a plurality of through holes formed therein. The water introduced into the tub 2 through the opening 3*h* may flow into the basket 3 through the through holes formed in the pulsator 4. A hub 12 may be coupled to the basket 3 near the opening 3*a*.

The casing may be provided with a control panel, which includes an input unit 30 for enabling various settings (e.g., the selection of courses, input of time or the like) to be selected by a user and to be input so as to operate the washing machine 1, and a display unit for displaying the operational state of the washing machine 1 (e.g., the state of progress of a course, the remaining time or the like). The input unit 30 may be configured to allow settings for the tub washing course to be input by a user. Based on the input setting through the input unit 30, the tub washing may be performed, a tub washing in progress may be stopped, or various settings pertaining to the tub washing course may be changed.

A controller 22 may include a microprocessor to control the operation of various devices or components of the washing machine 1.

A drive unit or a drive mechanism 18 may include a motor 18*a* for generating a rotational force, and a clutch for engaging the rotating shaft 18*b* of the motor 18*a* with the hub 12 or disengaging the rotating shaft 18*b* from the hub 12. The rotating shaft 18*b* of the motor 18*a* may be connected to the pulsator 4. The basket 3 may be rotated with the pulsator 4 when the rotating shaft 18*b* is engaged with the hub 12, whereas only the pulsator 4 may be rotated while the basket 3 is stopped when the rotating shaft 18*b* is disengaged from the hub 12.

A state in which the basket 3 is rotated with the pulsator 4 may be referred to as a "basket rotating mode", and a state in which only the pulsator 4 is rotated while the basket 3 is stopped or remains stationary may be referred to an "agitation mode". The pulsator 4 may be alternately rotated in opposite directions in the agitation mode. Although the pulsator 4 is described as being rotated in opposite directions in the agitation mode, the present disclosure may not be necessarily limited thereto. The agitation mode may also be performed by repeated rotation and braking of the pulsator 4 while the pulsator 4 is rotated in one direction.

The speed of the motor 18*a* may be controlled. For example, although the motor 18*a* may be a brushless DC (BLDC) motor, the present disclosure is not necessarily limited thereto. The technology or method for controlling the rotational speed of the basket 3 or the pulsator 4 using a motor such as a BLDC motor may be apparent to those skilled in the art, a detailed description thereof may be omitted.

The pulsator 4 may include a plurality of ribs extending radially from the center to generate a water stream or water flow. By designing the ribs to have an appropriate shape, a water displacement, flowing upward during the rotation of the pulsator 4, may be created in the basket 3.

The hub 12 may have a plurality of through holes 12*h*, which are circumferentially arranged around the rotating shaft 18*b*. When the basket 3 or the pulsator 4 is rotated, a water stream, which flows into the basket 3 from the tub 2 through the through holes 12*h*, may be created. The dotted arrow shown in FIG. 2 schematically indicates the water stream.

The washing machine may be provided with a filter 14 for filtering pollutants contained in the water stream passing through the through holes 12*h*. The filter 14 may include a filter frame 14*a* having filter holes 14*h*, formed at locations corresponding to the through holes 12*h*, and filter meshes 14*b* secured to the filter frame 14*a* so as to filter pollutants contained in the water stream passing through the filter holes 14*h*. Although the filter 14 is shown to be coupled to the lower surface of the hub 12, the present disclosure is not limited thereto.

The washing machine 1 may further include a water supply unit for supplying water to the inside of the tub 2 and a water discharge unit for discharging the water in the tub 2. The water supply unit may include a water supply valve 7 for opening or closing a water supply channel 5 connected to a water source such as a faucet or the like. The water supply channel 5 may be provided with a detergent box 6 such that the water supplied through the water supply channel 5 is supplied to the inside of the tub 2 or the basket 3 through the detergent box 6 when the water supply valve 7 is opened. In some embodiments, the washing machine may be provided with a nozzle for directly injecting water into the basket 3 without causing the water to pass through the detergent box 6.

The water discharge unit may include a water discharge pump 9 provided at the water discharge channel 8 so as to discharge the water in the tub 2 to the outside. The water discharge unit may further include a water discharge valve for opening or closing the water discharge channel 8. For example, the water discharge pump 9 is operated while the water discharge valve is open.

FIG. 4 is a flowchart showing a method of controlling the washing machine. FIG. 5 is a view sequentially showing the operation of the washing machine in a washing process, in which FIG. 5(*a*) shows a water supply step S11, FIG. 5(*b*) shows a soaking step S12, FIG. 5(*c*) shows a water supply step S13, and FIG. 5(*d*) shows a washing step S14. FIG. 6 is a cross-sectional view specifically showing the level of water in the tub shown in FIG. 5(*b*). FIG. 7 is a cross-sectional view showing the operation of the washing machine in a rinsing step of a rinsing process.

Referring to FIGS. 4 to 6, the method of controlling the washing machine may include a step S11 of supplying water into the inside of the tub 2 up to a first set level a first predetermined level H1, a step S12 of rotating the basket 3 to wash the filter 14, which is disposed between the openings 3*h* formed in the bottom of the basket 3 and the tub 2, using a water stream, a step S13 of supplying water to the inside of the tub 2 so as to elevate the level of water in the tub 2 to a second set level or a second predetermined level H2 from the first set level H1, and a step S14 of rotating the basket 3 so as to raise the water in the basket 3 and the tub 2 using centrifugal force and to cause the water to cross over the upper end of the basket 3 and to fall into the basket 3.

For example, the method may include a tub washing course including a washing process S10 and a rinsing process S20. A user may input a tub washing course execution command through the input unit 30. When the tub washing course execution command is input through the input unit 30, the controller 22 may control the washing machine 1 to execute the tub washing course.

The washing process S10 is a process of removing pollutants from the tub 2 and the components disposed in the tub 2. The washing process S10 may include the water supply step S11, the soaking step S12, the water supply step S13 and the washing step S14.

Referring to FIG. 5(*a*), in the water supply step S11, water is supplied to the inside of the tub 2 until the level of water in the tub 2 reaches the first set level H1. The washing machine 1 may include a water level sensor 16 (see FIG. 3) for detecting the level of water in the tub 2. If the level of water in the tub 2 is determined to have reached the first set level H1 based on the value detected by the water level sensor 16, the controller 22 may close the water supply valve 7.

The first set level H1 is determined such that at least a portion of the pulsator 4 is immersed in water. Since the filter 14 is positioned under the pulsator 4, the filter 14 is completely immersed in the water when the level of water in the tub 2 reaches the first set level H1.

In the water supply step S11, water may be supplied to the inside of the tub 2 together with detergent. As shown in FIG. 1, the detergent is contained in the detergent box 6. In the water supply step S11, the water supplied through the water supply channel 5 is mixed with the detergent while passing through the detergent box 6, and is supplied to the inside of the basket 3 or the tub 2. When the water supply step S11 is finished, no more detergent remains in the detergent box 6.

The detergent intended to clean (tub washing) the basket 3 or the tub 2 is distinct from that adapted to wash laundry. Commercial detergent dedicated to tub washing is already available on the market. The detergent may include at least one of an oxygen bleaching agent and an oxygen cleaning agent, but may not include a chlorine bleaching agent or an acidic cleaning agent. The stainless steel components (e.g., the basket 3 in the tub 2) may corrode if chlorine bleaching agent or acidic cleaning agent is used.

After the water supply step S11, the soaking step S12 is executed for the period of time taken for the detergent to sufficiently act on the tub 2 and the drum 3, the pulsator 4, the hub 12, the filter 14 and the like included in the tub 2. The soaking step S12 may be executed for an hour or more (e.g., 1 to 10 hours).

While the soaking step S12 is executed, the basket 3 may be repeatedly rotated and braked (basket rotation mode). As shown in FIGS. 5(*b*) and 6, a water stream or flow F, which is directed from the center of the basket 3 outward in the radial direction by the rotation of the basket 3, may be created (see FIG. 6), and pollutants may be removed from the surface of the filter 140 by the water stream F.

The soaking step S12 is intended to clean the lower part of the tub 2. In consideration of the load applied to the motor 18*a* during the creation of the water stream, the tub 2 may contain a minimum amount of water required to create the water stream. The first set level H1 may be determined so as not to exceed the water level at which the pulsator 4 is just completely immersed in water.

As shown in FIG. 6, in the soaking step S12, the water level between the tub 2 and the basket 3 is raised due the centrifugal force caused by rotation of the basket 3. The first set level H1 and the rotational speed of the basket 3 may be appropriately set such that the water raised between the tub 2 and the basket 3 cannot cross over the upper end of the basket 3. As shown in FIG. 6, since the raised water level between the basket 3 and the tub 2 is pressed to the inner surface of the tub 2, a surface of the water where the water is pressed to the tub 2 is separated from the drum 3*b*. For reference, reference character "g" designates the distance by which the water surface is separated from the drum 3*b*.

In the soaking step S12, the basket 3 may be repeatedly rotated and braked. The controller 22 may control the drive unit 18 to rotate for a predetermined period of time and then to be braked. The process of maintaining the drive unit 18 in the stopped state for a predetermined period of time and then rotating the drive unit 18 under the control of the controller 22 may be repeatedly executed. The repeated rotation of the drive unit 18 may be periodically executed until a predetermined period of time has elapsed since initiation of the soaking step S12. For example, the drive unit 18 may rotate for 10 seconds every 10 minutes.

After the soaking step S12, the water supply step S13 is executed to raise the level of water in the tub 2 to the second level H2 based on the additional water supply. When the level of water in the tub 2 is determined to have reached the second set level H2 based on the value detected by the water level sensor 16 after the water supply valve 7 is opened, the controller 22 may close the water supply valve 7.

Since the water supply step S13 is executed in the state in which no detergent remains in the detergent box 6 based on the previous execution of the water supply step S11, the water supplied from the water source connected to the water supply channel 5 is directly supplied to the inside of the tub 2.

The washing step S14 is executed in the state in which the level of water in the tub 2 reaches the second set level H2, and the basket 2 is rotated so as to cause the water stream to reach the upper region of the tub 2. An intense washing operation is performed in the lower region of the tub 2 in the soaking step S12. The washing step S14 is executed in the state in which the water level is raised higher than in the soaking step S12. The water between the tub 2 and the basket 3 is raised further by the rotation of the basket 2 and even the upper region of the tub 2 is cleaned.

In the washing step S14, the basket 3 may be rotated such that the water between the basket 3 and the tub 2 is raised by the centrifugal force, and then the water crosses over the upper end of the basket 3 and falls into the basket 3. In order to create the water stream or displacement, which falls into the basket 3, the rotational speed of the basket 3 and the second set level H2 may be set appropriately. The second set level H2 may be set within a range in which the water between the basket 3 and the tub 2 is raised and falls into the basket 3 when the basket 3 is rotated at 170 to 180 rpm.

In the washing step S14, the outer surface of the upper part of the basket 3 and the inner surface of the upper part of the tub 2 are washed by the water raised between the tub 2 and the basket 3, and the inner surface of the basket 3 is washed by the water stream, which falls into the basket 3. In the washing step S14, the created water displacement have sufficient intensity for the water stream, which crosses over the upper end of the basket 3 and falls into the basket 3, to strike the opposite inner surface of the upper part of the basket 3.

The rinsing process S20 may include a water discharge step S21, a water supply step S22, a rinsing step S23, a water discharge step S24 and a dewatering step S25.

The water discharge step S21 is a step of discharging water from the tub 2. After completion of the washing step S14, the controller 22 controls the water discharge pump 9 to discharge water from the tub 2 (and also controls the water discharge valve to be opened in some embodiments). Since the water passes through the filter 14 from above during the water discharge step, pollutants collected at the filter mesh 14*b* may be discharged into the water discharge channel 8 through a water discharge port, together with the water.

In the water discharge step S21, the controller 22 may control the drive unit 18 to rotate the basket 3 during the water discharge step (basket rotation mode). At this time, the basket may be continuously rotated in one direction. Although the basket 3 may be rotated during the entire water discharge step, the present disclosure is not limited thereto. A water stream F, which is directed outward in the radial direction from the center of the basket 3 by rotation of the basket 3, is created between the base 3*a* of the basket 3 and the tub 2 (see FIG. 6), and pollutants may be separated from the surface of the filter 14 by the water stream F.

Since cleaning of the filter 14 by the water stream F is implemented during the water discharge step S13, the pollutants, which are separated from the filter 14, are discharged through the water discharge channel 8, together with the water. Accordingly, it is possible to prevent the pollutants, which are separated from the filter 14, from being introduced into the basket 3 again.

The water supply step S22 is executed after the water discharge step S21 such that water is supplied to the inside of the tub 2 to a predetermined level by opening the water supply valve 7. The predetermined level is set such that a water stream of FIG. 7 is created in the rinsing step S23, which is executed after the water supply step S22, and may be set to be equal to or higher than the second level H2.

The rinsing step S23, which is executed after the water supply step S22, is a step of supplying water to the inside of the tub 2 again to rinse the components disposed in the tub 2. The rinsing step S23 may include a first rinsing step of rotating the basket 3 so as to raise the water between the tub 2 and the basket 3, to cross over the upper end of the basket 3 and to fall into the basket 3 (see FIG. 7(*a*)), a second rinsing step of repeating the rotation and stoppage of the basket 3 (see FIG. 7(*b*)) and a third rinsing step of repeatedly rotating only the pulsator 4 in opposite directions while maintaining the basket 3 in the stopped state (see FIG. 7(*c*)).

In the first rinsing step of FIG. 7(*a*), the basket 3 may be continuously rotated in one direction for a predetermined period of time (basket rotation mode). In the first rinsing step, the water between the tub 2 and the basket 3 is raised, crosses over the upper end of the basket 3 and falls into the basket 3 again, similar to the washing step S14. Although the rotational speed of the basket 3 in the first rinsing step is within a range of 170 to 180 rpm, the present disclosure is not limited thereto.

The second rising step (basket rotation mode) of FIG. 7(*b*) is executed after the first rinsing step, and rotation and stoppage of the basket 3 are repeatedly performed. In the second rinsing step, the basket 3 is rotated at a lower speed than in the first rinsing step, and the water between the tub 2 and the basket 3 may not cross over the upper end of the basket 3 even though the water is raised.

Even if pollutants are adhered to the basket 3 or the tub 2 again by the water stream F, which is created in an outward radial direction using the centrifugal force in the step before the second rinsing step, the pollutants may be separated from the basket 3 by the inertia during the repeated rotation and stoppage of the basket 3. The basket 3 may be alternately rotated in opposite directions in the second rinsing step. The change of rotational direction of the basket 3 may enable pollutants to be more easily separated from the basket 3 due to inertia.

The third rinsing step of FIG. 7(*c*) is executed after the second rinsing step in such a manner that the pulsator 4 is alternately rotated in opposite directions while the basket 3 is stopped (agitation mode). By designing the pulsator 4 in an appropriate shape, an upward flow may be created in the basket 3 by rotation of the pulsator 4. At this time, a water stream, which is directed into the basket 3 through the filter holes 14*h* and the through holes 12*h* formed in the hub 12, is developed in the tub 2. In the third rinsing step, pollutants may be removed from the rear surface of the pulsator 4 or the upper surface of the filter 14, and pollutants present in the tub 2 may be collected at the filter 14 again.

After the third rinsing step is executed for a period of time, the water discharge step S24 may be executed. The controller 22 may control the water discharge pump 9 to operate so as to discharge the water in the tub 2. In the water discharge step S24, the basket 3 may be rotated, like the water discharge step S21.

In some embodiments, after the completion of the water discharge step, water may be supplied again, and the first rinsing step, the second rinsing step and the third rinsing step may be sequentially executed. The process may be repeated a predetermined number of times.

After the water discharge step S24, the dewatering step S25 removes moisture adhering to the basket 3 from the basket 3 by rotating the basket 3 at a high speed (basket rotation mode). The dewatering step S25 may include a step of accelerating the basket 3, which is rotated in the water discharge step S24, to a predetermined dewatering speed. However, the present disclosure is not limited thereto, and the method may include a step of stopping rotation of the basket 3 upon completion of the water discharge step S34 and then accelerating the basket 3 to the dewatering speed.

Various embodiments have been described in the best mode for carrying out the invention. Although the embodiments of the present disclosure have been disclosed for illustrative purposes, those skilled in the art will appreciate that various modifications, additions and substitutions are possible, without departing from the scope and spirit of the invention as disclosed in the accompanying claims.

The invention claimed is:

1. A washing machine comprising:

a tub for storing water;

a basket provided in the tub and rotatable about a vertical axis, the basket having an opening formed at a bottom to allow the basket to communicate with the tub and a plurality of through holes formed at a side wall to allow water to flow laterally;

a pulsator rotatably provided at a lower portion of the basket;

a filter for filtering water that flows from the tub to the basket through the opening during the rotation of the pulsator;

a water supply valve for supplying water to the tub;

a water discharge pump for discharging water from the tub;

a drive mechanism for driving at least one of the pulsator and the basket; and a controller configured to controlling the water supply valve so as to supply water to a first predetermined level, controlling the drive mechanism to rotate the basket so as to wash a filter provided between the tub and an opening formed at a bottom of the basket by a water flow, controlling the water supply valve so as to elevate a water level from the first predetermined level to a second predetermined level, and controlling the drive mechanism to rotate the basket so as to raise water between the basket and the tub above an upper end of the basket using the centrifugal force and to fall into the basket.

2. The washing machine according to claim 1, wherein the controller controls the drive mechanism to repeatedly perform rotation and braking of the basket for a predetermined period of time while a water level is maintained at the first set level.

3. The washing machine according to claim 2, wherein the controller controls the drive mechanism to repeatedly perform the rotation and braking of the basket at regular intervals.

4. The washing machine according to claim 1, wherein when water is being supplied to the tub to raise the water level to the first predetermined level, the water is supplied together with detergent.

5. The washing machine according to claim 4, wherein the detergent includes at least one of an oxygen bleaching agent and an oxygen cleaning agent.

6. The washing machine according to claim 1, wherein at least a portion of the pulsator is immersed in water at the first predetermined level of water.

7. The washing machine according to claim 1, wherein the controller controls the drive mechanism to rotate the basket so as to displace water between the basket and the tub above an upper end of the basket using the centrifugal force and to fall into the basket, and then controls the water discharge pump to discharge water in the tub.

8. The washing machine according to claim 7, wherein the controller controls the drive mechanism to rotate the basket while the water discharge pump is operated.

9. A method of controlling a washing machine, comprising:

(a) supplying water to a tub to a first predetermined level;

(b) rotating a basket so as to wash a filter provided between the tub and an opening formed at a bottom of the basket by a water flow;

(c) supplying water to elevate a water level in the tub from the first predetermined level to a second predetermined level; and (d) rotating the basket to raise water between the basket and the tub above an upper end of the basket by centrifugal force and to fall into the basket.

10. The method according to claim 9, wherein the step (b) of rotating a basket includes repeatedly performing rotation and braking of the basket for a predetermined period of time.

11. The method according to claim 10, wherein the rotation and braking of the basket are repeatedly performed at regular intervals.

12. The method according to claim 9, wherein in the step (a) of supplying the water, the water is supplied together with detergent.

13. The method according to claim 12, wherein the detergent includes at least one of an oxygen bleaching agent and an oxygen cleaning agent.

14. The method according to claim 9, wherein the first predetermined value is set such that at least a portion of a pulsator, which is provided at a lower portion of the basket above the filter, is immersed in water.

15. The method according to claim 9, further comprising (e) discharging water in the tub after the step (d) of rotating the basket.

16. The method according to claim 15, wherein the step (e) of discharging the water includes rotating the basket while the water in the tub is discharged.

17. The method according to claim 16, wherein after the step (e) of discharging the water, the method further comprises:

(f) supplying water to the tub;

(g) rotating at least one of the basket and the pulsator; and (h) discharging water in the tub.

18. The method according to claim 17, wherein the step (h) of discharging the water in the tub includes rotating the basket while the water in the tub is discharged.

19. The method according to claim 18, wherein, in the step (h) of discharging the water in the tub, the basket is rotated in a direction opposite to that in the step (e) of discharging the water in the tub.

20. The method according to claim 9, further comprising inputting a tub washing execution command through an input unit, wherein the step (a) of supplying the water, the step (b) of rotating the basket, the step (c) of supplying the water and the step (d) of rotating the basket are executed in response to the tub washing execution command input through the input unit.

* * * * *